US006921260B2

(12) United States Patent
Garnys

(10) Patent No.: US 6,921,260 B2
(45) Date of Patent: Jul. 26, 2005

(54) CANDLES WITH COLORED FLAMES

(75) Inventor: Vyt Garnys, Clayton North (AU)

(73) Assignee: Novaflame Pty. Ltd., Victoria (AU)

( * ) Notice: Subject to any disclaimer, the term of this patent is extended or adjusted under 35 U.S.C. 154(b) by 0 days.

(21) Appl. No.: 10/479,415

(22) PCT Filed: Jun. 3, 2002

(86) PCT No.: PCT/AU02/00703

§ 371 (c)(1),
(2), (4) Date: Dec. 3, 2003

(87) PCT Pub. No.: WO02/099022

PCT Pub. Date: Dec. 12, 2002

(65) Prior Publication Data

US 2004/0137392 A1 Jul. 15, 2004

(30) Foreign Application Priority Data

Jun. 4, 2001 (AU) ..... PR5431
Dec. 6, 2001 (AU) ..... PR9302
Dec. 24, 2001 (AU) ..... PR9670

(51) Int. Cl.[7] ..... F23D 3/16; C11C 5/008

(52) U.S. Cl. ..... 431/126; 431/268; 431/289; 431/325; 44/275

(58) Field of Search ..... 431/126, 268, 431/288, 289, 298, 325; 44/275

(56) References Cited

U.S. PATENT DOCUMENTS 3,428,409 A * 2/1969 Summers ..... 431/289
3,582,251 A * 6/1971 Concannon ..... 431/126
3,940,233 A * 2/1976 Fox et al. ..... 431/325
4,386,904 A * 6/1983 Miyahara et al. ..... 431/126
4,568,270 A * 2/1986 Marcus et al. ..... 431/288
6,111,055 A * 8/2000 Berger et al. ..... 528/310
6,162,046 A * 12/2000 Young et al. ..... 431/11
6,699,034 B2 * 3/2004 Schoeck ..... 431/288
6,770,104 B2 * 8/2004 Murphy ..... 44/275

FOREIGN PATENT DOCUMENTS

DE 19961547 6/2001
DE 19961548 6/2001
FR 2639356 5/1990

OTHER PUBLICATIONS

Home of Poi http://www.homeofpoi.com/shop/listltem-s.php/fire/47/poi/298.*
Fireworks LTD. http://www.firetoys.co.uk/cgi–bin/acatalog/Fire_wicks$_{13}$ and_ropes.html.*
Derwent Abstract Accession No. 95–345204/45, CN 1095099 A (LU) Nov. 16, 1994.
Derwent Abstract Accession No. 08356C/05, JP 5 4160 068 A (Pagasus Candle KK) Dec. 18, 1979.
Derwent Abstract Accession No. 95–216171/29, CN 1087115 A (Wuhan Chem Eng College) May 25, 1994.
International Search Report.

* cited by examiner

*Primary Examiner*—Cheryl Tyler
*Assistant Examiner*—James G. Barrow
(74) *Attorney, Agent, or Firm*—Connolly Bove Lodge & Hutz LLP

(57) ABSTRACT

A candle with transparent flame and flame temperature higher than paraffin candles consists of a fuel mix consisting of sorbitol, ethane diol and glycerol with a polyaramid wick. The candle can be used in catering and for the production of colored flames. For colored flames a colorant wick delivers the colorant to the portion of the flame that maximises the temperature and the residence time of the colorant in the flame. The colorant wick may be spirally wound around a former, heat set and then threaded with the combustion wick so that when alight the free end of the colorant wick relaxes to lie in the hottest portion of the flame.

8 Claims, 1 Drawing Sheet

CANDLES WITH COLORED FLAMES

FIELD OF THE INVENTION

This invention relates to improvements in candles and particularly to the fuel and wicks used in candles and to the ability to produce smokeless and coloured flames.

BACKGROUND TO THE INVENTION

Candles generally use paraffin wax and cotton wicks. Parrafin has the disadvantage that combustion is incomplete and fine particulates or soot is produced. The flame is generally yellow and the temperature of the flame is usually not high enough to provide sufficient heat for cooking or food warming. These characteristics make paraffin candles unsuitable for catering applications and for use in producing coloured flames.

For catering, alcohol is usually used but, being a liquid, spillage can cause safety problems. U.S. Pat. No. 5,858,031 discloses water alcohol mixtures that may also be gelled. Isopropanol is included to provide flame visibility as a safety precaution. For camp stove use hexamine has proved to be the heating fuel of choice but is unsuitable for indoor use because of the nitrogen oxides produced in combustion. To produce a coloured flame by the addition of colouring agents it is best to begin with a colourless flame.

Alternate fuels that can produce a colourless flame have been suggested and U.S. Pat. No. 2,551,574 included examples which use mannitol, and mannitan mono stearate and sorbitan monostearate as the main candle body.

U.S. Pat. No. 4,997,547 uses methyl alcohol and ethylene glycol and a cellulose ester to produce a gelled fuel to which colouring agents may be added.

A difficulty with non paraffin fuels is that the higher flame temperature creates a higher burn rate for the cotton wick and thus yellow the flame.

Although there have been suggestions to produce coloured flames none have been widely adopted.

U.S. Pat. No. 3,586,473 suggests that the colourant be incorporated in the rim of the candle so that the rim touches the edge of the flame. This construction would not work with wide candles. It is restrictive, suffers loss of precision if the candle burns unevenly and the support polymers suggested, produce undesirable odours and toxic gases.

U.S. Pat. No. 4,386,904 proposes the use of two wicks. The colouring wick is positioned at a lower edge of the flame and is of a similar material to the combustion wick [cotton]. This candle construction is not suitable for fuels which produce reactants with the colourant, its flame shape is distorted by the presence of the second wick and the relative burn rate is difficult to control.

It is an object of this invention to provide a candle which can support higher flame temperatures and at the same time provide a colourless flame [if desired] and low levels of soot and noxious gases.

BRIEF DESCRIPTIONS OF THE INVENTION

To this end the present invention provides a candle in which the fuel consists of a mixture of components that are mouldable into a solid shape at ambient conditions wherein the components are a) a major portion of a C-6 polyalcohol or esters thereof
b) a minor portion of a C-2 or C-3 diol
c) and a minor portion of a plasticizer and all the components are composed only of oxygen, carbon and hydrogen.

This invention is partly predicated on the discovery that flame temperature, flame height, burn rate and flame transparency can be varied by varying the content of the diol and plasticizer. The carbon content of the molecules used in the fuel components should be no higher than 50% to avoid incomplete combustion which results in soot formation and flame luminosity.

The preferred C-6 polyalcohol is sorbitol although mannitol and esters of sorbitol or mannitol such as stearates may be used. Mannitol has the advantage of having lower water absorption than Sorbitol. This provides the bulk of the fuel and is selected for its melting temperature and low flame luminosity and ability to be moulded into shaped products. Further because these compounds are available as food grade products they are non toxic and safe. The polyalcohol forms about 60 to 80% of the candle fuel.

The preferred diol is ethanediol (ethylene glycol) and is used to adjust the flame height, flame temperature and burn rate of the fuel. It increases flame temperature and burns with a transparent flame. The diol may comprise up to 20% of the fuel. The amount of the diol is determined by the proposed use of the fuel. For heating use (eg: catering and camp stove) a higher flame temperature is desired and the diol content is increased. Because of the benign emissions the candle can be used indoors and in enclosed spaces such as tents.

The plasticizer is used to facilitate the blending of the diol and the polyalcohol into a stable mouldable composition. The preferred plasticizer is glycerol. The plasticizer may comprise up to 20% of the fuel. Usually the glycerol content is adjusted to blend the diol content with the polyalcohol.

The fuel may have added to it any of the usual adjuvants or additives that are used for candles including colouring agents to colour the candle body, fragrances, and biologically active molecules such as insecticides. Because the solubility characteristics of the sorbitol/mannitol system is different to paraffin not all adjuvants used with paraffin candles will be suitable. However many adjuvants used with food such as food colourants are suitable for use in the fuel composition of this invention. Paraffin may also be added to provide luminosity to the flame where this is desired. Ethanol and higher alcohols may be added in small amounts to adjust flame height and luminosity. These additives will normally constitute less than 10% by weight of the fuel.

An advantage of the fuel composition of this invention derives from its water solubility. Fuel spillages from burning candles onto table cloths or clothes do not stain and can easily be washed out. Spent candles are environmentally benign as well and can be disposed of in landfill.

In a further aspect this invention provides a candle having a wick composed of a synthetic carbon based material which decomposes above 400° C. and chars without losing structural integrity up to temperatures above 1000° C.

Cotton wicks generally decompose at 250° C. and lose structural integrity below 1000° C. Non carbon based wicks such as fibre glass are not consumed and will extend well above the candle once fuel is consumed.

The preferred wick material is selected from thermally resistant polymers of compounds that meet these requirements. Polyamides which are members of the class of liquid crystalline polymers are the most suitable class of polymers and in particular polyparabenzamineterephthalamide or polymetabenzamineterephthalamide are preferred. These polymers are generally known as polyaramids and one preferred class are marketed under the brand name Kevlar®. These wicks are best used with the fuel of this invention for catering candles and also as decorative candles. Glass fibre and carbon fibre wicks may be used for candles of reasonably fixed dimensions or if wick emissions need to be controlled during combustion.

In another aspect this invention provides a coloured flame candle in which the candle consists of a) a fuel capable of providing a flame of low luminosity and a flame temperature greater than that provided by paraffin
b) a combustion wick
c) a colourant delivery wick adapted to deliver the colourant to the portion of the flame that maximises the temperature and the residence time of the colourant in the flame.

This invention is predicated on the realisation that satisfactory flame colour to be most effective, is dependent on flame temperature and the residence time of the colourant in the high temperature portion of the flame. This cannot be satisfactorily achieved by mixing the colourant in the fuel as proposed in prior patents. The delivery wick may be separate from the combustion wick or may be interwoven or formed with the combustion wick to ensure that it extends into the lower edge of the hottest portion of the flame. The colourant wick may be impregnated with a solution of the colourant material or may extend into a reservoir of the colourant solution. Carbonised starch is one material which has performed adequately as a colorant wick. It is preferred to use a fibrous absorbent material as the colourant wick to maximise the amount of colourant that may be absorbed into the wick. The colourant wick also needs to have a high decomposition temperature compared to cotton as well as structural integrity in the charred state. Again polyaramids that are fibrous or are woven or non woven materials are preferred as providing the optimum mix of these properties. Surface treated polyparabenzamineterephthalamide (to improve absorbency) sold under the brand Kevlar® or polymetabenzamineterephthalamide sold under the brand Nomex® are preferred.

In a further aspect this invention provides a candle which burns with a coloured flame which includes a) a combustion wick
b) a colourant delivery wick spirally wound around the combustion wick
c) the colourant delivery wick being composed of a material that relaxes in the heat at the base of the flame so that it extends into the portion of the flame that maximises the temperature and the residence time of the colourant in the flame.

In forming the colourant wick the material that can be wound about the combustion wick and relax in the flame need not be a wicking or absorbent material but can be combined with such a material as long as one of the two components also burns at the same rate as the combustion wick and retains its structural integrity. Preferably the material that chars above 400° C. can also be heat set into a spiral and then relaxes in the flame. This material may be tubular so that an absorbent or wicking material can be threaded in the tube to deliver the colourant. Preferably the delivery material and the material capable of relaxing in the flame is the same and an absorbent polyaramid material is preferred.

The polyaramid material used for the colourant wick can be heat set into the spiral shape and then the combustion wick can be threaded through the spiral. The heat setting temperature is within the range of 80° C. to 120° C. and is selected so that the degree of relaxation ensures that the end of the spiral uncurls as far as the outer edge of the lower part of the flame.

The colourant materials may be any known metal salts capable of producing desirable colours although for health and occupational safety reasons lithium, strontium and copper salts are preferred. The salts may be carbonates, nitrates, stearates, acetates, citrates, halides and organometallics with chlorides being preferred.

DETAILED DESCRIPTION OF THE INVENTION

Preferred embodiments of the invention are illustrated in the drawings in which

Figure 1:
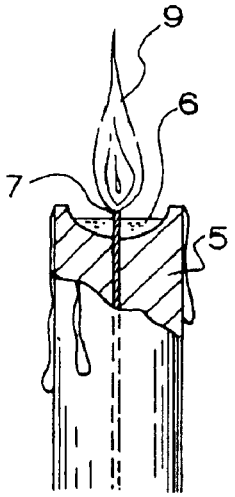
FIG. 1 illustrates a catering candle according to this invention.

As shown in FIG. 1 a catering candle or basic version comprises a candle body 5 formed of the solid fuel of this invention. The combustion wick 7 extends through the body 5 of the candle and projects above the melt pool 6 created in the top surface of the candle body 5 by the radiant heat of the flame 9 which extends above the wick 7.

Figure 2:
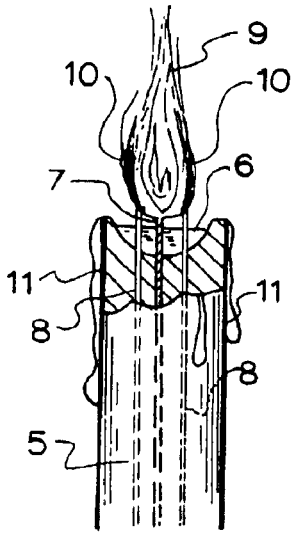
FIG. 2 illustrates a first embodiment of a coloured flame candle.

In FIG. 2 one or more colorant wicks 8 extend parallel to the combustion wick 7 into the hottest portion 10 of the flame 9. It is the portion 10 which becomes coloured by the introduction of the colourant. Where the fuel forming the body 5 is hygroscopic a coating 11 of hydrophobic material such as paraffin is used to protect the body 5.

Figure 3:
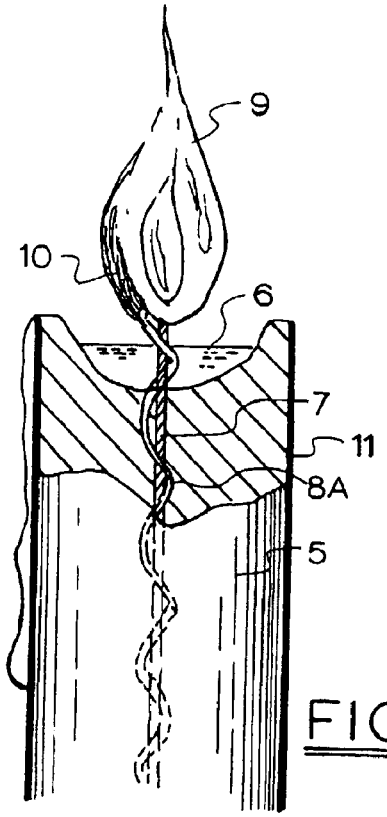
FIG. 3 illustrates a second embodiment of a coloured flame candle.

In FIG. 3 a variation on the design of FIG. 2 is shown where the colourant wick 8A is spirally wound around the combustion wick 7. As the wick 7 burns the colourant wick 8A relaxes and its end lies in the region 10 of the flame 9.

Figure 4:
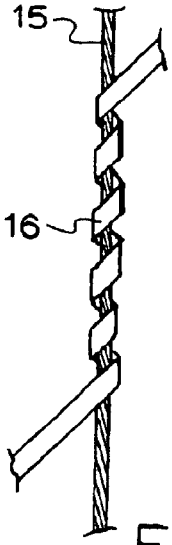
FIG. 4 illustrates a method of forming the colourant wick of the FIG. 3 embodiment.

The colourant wick is formed as shown in FIG. 4 where a strip of wick material 8A is wound onto a former 15 and heat set into a spiral shape. The former 15 is removed and the combustion wick 7 is threaded through to obtain the combination as shown in FIG. 3.

Fuel

The candles prepared according to this invention generally have a composition of 75% sorbitol, 12.5% ethane diol and 12.5% glycerol. One particular fuel for heating or coloured flames comprises 75 g Sorbitol, 15.4 g Ethane diol, 12.6 g Glycerol and 0.1 g of polypropylene wax.

The materials are mixed as a melt and then allowed to crystallise in the mold. Vigorous shearing of the mix or seeding to encourage nucleation assists in rapid crystallisation of the fuel. Moulding can be achieved by pouring the melt into moulds, by pressing, or by extrusion.

The fuel is hygroscopic and does absorb water and it has been found necessary to coat the candle body in paraffin or similar water repellant coating to inhibit water absorption. The candles may be dipped brushed or sprayed with paraffin wax melting between 40–200° C. This property means that the candles can be sold for single use as once the candle has been used the fuel is exposed and the water absorption that occurs will make the candle more difficult to reignite. This feature renders the candle less easy to burn in a fire and is safer around children. The candles of this invention can be easily extinguished with water if needed unlike pooled burning of paraffin. If the candles need to be reignited easily paraffin wax melting between 40–100° C. can be added to the melt pool at the end of the burning cycle to saturate the wick with paraffin to control water absorption.

An alternative fuel which is less hygroscopic is to use mannitol or blends of sorbitol and mannitol.

The candle may be coloured by addition of dyes or colouring agents to the fuel and perfumes or fragrances may also be added. The water proof or paraffin coating may also coloured. Most of the coatings conventionally used for paraffin candles may be used. Fragrances, insecticides, odour inhibitors, anti-tobacco odour suppressants may be added. These additives will usually be stable at 100–200° C. and can be added to the fuel.

Combustion Wick

The combustion wick is made from Kevlar® fibres. To improve wicking and to facilitate initial ignition the wicks are impregnated with sorbitol or the actual candle fuel and coated with paraffin to inhibit water absorption. An alternative is to impregnte the wick with a non water absorbent fuel starter, such as polyethylene glycol, that does not inhibit wicking of the fuel. The wick is preferably about 2 mm in diameter.

The Kevlar® wicks char and remain upright and stable in the melt pool which forms from the candle fuel around the base of the wick. The candles are ignitable using conventional matches or gas flames at 600–1000° C.

The burn rates for these candles are about 5–7 grams of fuel per hour and can be controlled by wick design and fuel formulation.

It has been found that candles made in this way burn with a transparent hot flame that can be used in catering without any of the problems of taint from smoking fuels or the safety problems of liquid fuels. The candles comply with international indoor air quality standards. Another important advantage in manufacturing and consumer use is that the fuel is water soluble and biodegradable which allows waste or spillages to be easily washed away or reclaimed for purification and reuse.

These candles are also useful as coloured flame candles because the flame height and temperature allow colourants to have a sufficiently high temperature and residence time in the flame.

Colourant Delivery

The colourant is delivered using a range of meta aramid papers such as Nomex® paper [non woven fabric] strip impregnated with the colourant solution. The colourant wick may be cut as a rectangular strip that is curved and placed adjacent the combustion wick so that the upper edge of the colourant wick extends partly circumferentially around the lower edge of the hottest portion of the flame which is the outer surface of the flame. Alternately the Nomex® paper may be twisted, woven or supported together with the Kevlar® combustion wick so that the end of the colourant wick remains in the outer lower edge of the flame. A preferred structure is to spirally wind the meta polyaramid on a wire mandrel and heat set it at about 100° C. The para polyaramid combustion wick is then threaded through. When the combustion wick is lit the meta polyaramid spiral relaxes adjacent the bottom of the flame to deliver the colourant to the hottest edge of the flame.

It is preferred to coat the colourant wick to prevent leakage of the colourant into the fuel. These metal salts may react with the fuel or absorb water and therefor a coating of polypropylene or ethyl cellulose may be used for copper salts or poly propylene wax may be used for all colourants. The coating may be a preformed film or more preferably a thin walled tube of polypropylene or ethyl cellulose of wall thickness of about 50 microns. The meta polyaramid is 1) soaked in sheet form in the colourant solution
2) slit into wicks of appropriate width and length
3) threaded into a tube of polypropylene or ethylcellulose
4) spirally wound on a mandrel
5) heat set at about 100° C.
6) then the combustion wick is threaded into the spiral.

The strength of the polyaramid dominates the coated colourant wick which behaves much the same as an uncoated wick.

The preferred colourants used are lithium chloride for red, and cuprous or cupric chloride for green/blue. However nitrates, stearates, organometallic and other compounds such as those of calcium, strontium, magnesium, aluminium, iron, or potassium may be used. A preferred red flame is produced with lithium chloride on a poly meta-aramid strip coated with polypropylene.

From the above it can be seen that the present invention provides a unique fuel and wick structure for candles that is safe and has excellent combustion so that particulates and toxic gases are reduced.

What is claimed is:

1. A combustion and colourant wick combination for use in a candle which includes a) a combustion wick composed of a synthetic carbon based material which decomposes above 400° C. and chars without losing structural integrity at temperatures in the range of 1000° C. to 1400° C.

b) a colourant delivery wick spirally wound around the combustion wick c) the colourant delivery wick being composed of a material that relaxes in the heat at the base of the flame so that it extends into the portion of the flame that maximises the temperature and the residence time of the colourant in the flame.

2. A coloured flame candle comprising:

a) a fuel having of a mixture of components that are mouldable into a solid shape at ambient conditions wherein the components are i) a major portion of a C-6 polyalcohol, esters or stearates thereof ii) a minor portion of a C-2 to C-4 diol iii) and a minor portion of a combustible plasticizer and all the components are composed only of oxygen, carbon and hydrogen b) a combustion wick c) a colourant delivery wick adapted to deliver the colourant to the portion of the flame that maximises the temperature and the residence time of the colourant in the flame.

3. A candle as claimed in claim 2 in which the fuel includes 60–80% sorbitol and/or mannitol, 10–20% of ethane diol and 10–20% of glycerol.

4. A candle as claimed in claim 2 which is coated in paraffin to inhibit water absorption by the fuel.

5. A candle as claimed in claim 4 in which the wick material is selected from polyaramids.

6. A candle an claimed in claim 2 which the combustion wick is composed of a synthetic carbon based material which decomposes above 400° C. and chars without losing structural integrity at temperatures in the range of 1000° C. to 1400° C.

7. A candle as claimed in claim 1 which includes a) a colourant delivery wick spirally wound around the combustion wick b) the colourant delivery wick being composed of a material that relaxes in the heat at the base of the flame so that it extends into the portion of the flame that maximises the temperature and the residence time of the colourant in the flame.

8. A colourant delivery wick as claimed in claim 7 which is composed of a meta polyaramid that has been soaked in colorant solution and coated with polypropylene or ethyl cellulose.

* * * * *